United States Patent [19]

Monte et al.

[11] 4,159,744

[45] Jul. 3, 1979

[54] FIRE EXTINGUISHANT MECHANISM

[76] Inventors: Anthony J. Monte, 47600 Bluebird, Utica, Mich. 48087; Ernest C. Wahoski, 20489 Lancaster, Harper Woods, Mich. 48225

[21] Appl. No.: 858,925

[22] Filed: Dec. 9, 1977

[51] Int. Cl.[2] ..... A62C 35/12; A62C 37/06; A62C 37/18

[52] U.S. Cl. ..... 169/26; 169/62; 169/75; 251/144

[58] Field of Search ..... 169/26–28, 169/60, 61, 62, 74, 75; 137/68 A; 251/144

[56] References Cited

U.S. PATENT DOCUMENTS

| | | | |
|---|---|---|---|
| 3,464,497 | 9/1969 | Globerman et al. | 169/60 |
| 3,552,495 | 1/1971 | Fiero | 169/75 X |
| 3,762,479 | 10/1973 | Fike, Sr. et al. | 169/74 X |

FOREIGN PATENT DOCUMENTS

| | | | |
|---|---|---|---|
| 1064027 | 5/1954 | France | 169/74 |
| 267542 | 6/1927 | United Kingdom | 169/62 |
| 545368 | 5/1942 | United Kingdom | 169/26 |

*Primary Examiner*—Robert B. Reeves
*Assistant Examiner*—Andres Kashnikow
*Attorney, Agent, or Firm*—Peter A. Taucher; John E. McRae; Nathan Edelberg

[57] ABSTRACT

A fire-extinguishant mechanism comprising a thick-walled bottle containing pressurized fire extinguishant liquid. Liquid outflow from the bottle is through a poppet valve located at the lower end of the bottle; the valve discharges pressurized extinguishant in one or more preselected directions, depending on the location or application of the bottle system; valve actuation is by means of an explosive squib and/or explosive cartridge (as backup). The bottle is initially filled and pressurized through a multi-purpose fitting at the bottle upper end; a filler tube extends from the fitting downwardly into the bottle to introduce the pressurizing agent below the liquid extinguishant surface. The fitting is specially constructed to mount a charging valve, a pressure gage, rupture disc, and liquid deflection mechanism.

9 Claims, 7 Drawing Figures

FIRE EXTINGUISHANT MECHANISM

The invention described herein may be manufactured, used, and licensed by or for the Government for governmental purposes without payment to us of any royalty thereon.

BACKGROUND AND SUMMARY OF THE INVENTION

This invention relates to fire extinguishant bottle mechanisms of the type shown for example in U.S. Pat. No. 3,209,937 issued to R. Hirst et al. or U.S. Pat. No. 3,915,237 issued to E. Rozniecki. Such mechanisms commonly comprise upright bottles charged with a pressurized liquid fire extinguishant material such as $CF_3Br$ (brand name Halon 1301); the pressurizing agent is commonly nitrogen, and the charging pressure is usually sufficient to bring the bottle pressure up to about 750 p.s.i. In the absence of the pressurizing agent the fire extinguishant material would have a vapor pressure of about 229 p.s.i.a. at 75° F. An automatic valve is located at the lower end of the bottle to discharge the pressurized extinguishant toward the developing fireball.

In one particular system, developed for use in military vehicles to combat explosive fires generated by enemy bullets fired through the vehicle fuel tank, the automatic valve is triggered to the valve-open condition by means of an optical sensor responsive to radiations produced by the developing fireball. The electrical signal generated by the activated sensor is amplified and directed through a hot wire filament contained within a small explosive squib suitably mounted on the valve. As the squib explodes high pressure gases (about 3000–4000 p.s.i.) are generated behind a piston-like cutter element aligned with a diaphragm that seals the liquid extinguishant within the charged bottle; the cutter element severs the diaphragm from the valve body (partially or wholly) to enable the pressurized extinguishant to flow rapidly through the valve toward the developing fireball. In a preferred arrangement the entire process from initial activation of the sensor to extinguishment of the fireball takes place in 100 milliseconds or less.

In military vehicles the space available for the bottle-valve assembly is somewhat restricted. It is therefore desirable that the valve occupy minimum space below the bottle. Another desirable feature is the inclusion of a back-up actuator for the valve in the event that the explosive squib fails to fire. The present invention is directed to a valve structure having these desired features, namely small space requirement and back-up actuation means. In a preferred arrangement the valve is designed for relatively low cost manufacture, using relatively few component parts. The valve element is a poppet valve rather than the commonly-used rupturable diaphragm; therefore the valve assembly can be reused (after each fire-extinguishant activity) without need for valve element replacement. Preferred poppet valve resembles the intake-exhaust valves commonly used in internal combustion engines for withstanding high combustion chamber pressures.

In systems using Halon 1301 it is necessary that the pressurizing agent (nitrogen) be intimately mixed with the liquid extinguishant when the agent is first introduced to the bottle; such mixing promotes rapid dissolving of the agent in the Halon. If the pressurizing agent and Halon do not go into solution during the charging period then slow dissolving of the agent after completion of the charging operation will result in a lowered bottle pressure and consequent slow Halon released toward the fireball when the valve is opened. Intimate mixture of the pressurizing agent and the Halon during the initial charging operation may be achieved by agitation of the bottle and/or slow bubbling of the agent from the bottom of the bottle upwardly through the extinguishant liquid. Conventional practice is to charge the bottle through a small bypass opening in the aforementioned diaphragm valve. Our valve design is not especially suited to the incorporation of a bypass opening for charge-in action. Therefore we provide a separate charge-in fitting at the top of the bottle; a filler tube extends from this fitting downwardly into the bottle to introduce the pressurizing agent into the bottle at a point below the surface of the liquid extinguishant. The agent is permitted to slowly bubble upwardly through the liquid, thereby assisting the agent to go into solution.

The separate charge-in fitting at the top of the bottle advantageously incorporates a safety rupture disc and pressure gage. In conventional arrangements where the bottom valve is used for charging purposes it is not always possible to incorporate a pressure gage and/or safety disc without unduly complicating the valve, increasing its manufacturing cost, or appreciably increasing its bulk. Our arrangement provides a combination of features not always available in comparable prior art arrangements. Use of a separate charge-in valve at the upper end of the bottle is compatible with high flow rate, rapid response discharge valve at the lower end of the bottle.

THE DRAWINGS

Figure 7:
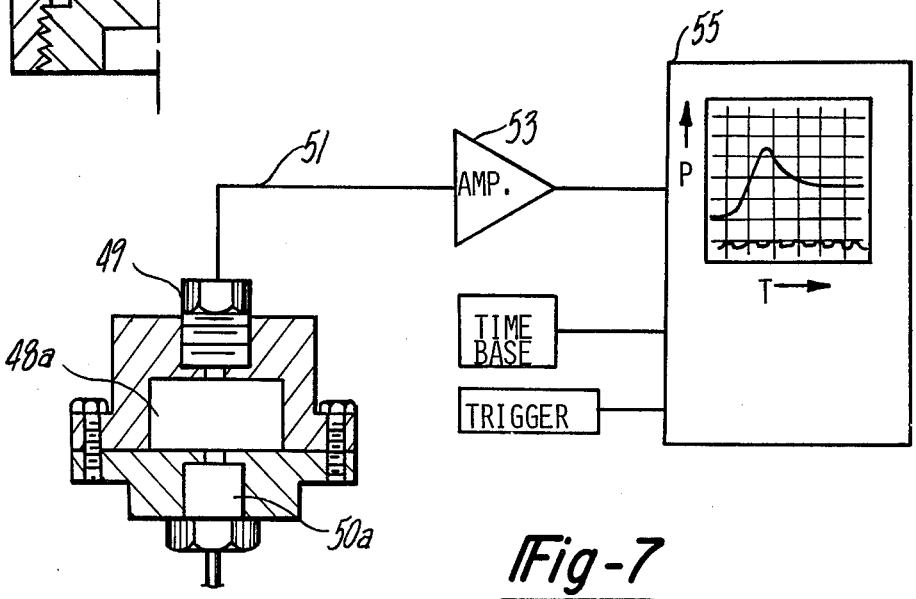

FIG. 7 schematically depicts a test fixture and test set-up used to obtain squib performance curves.

Figure 1:
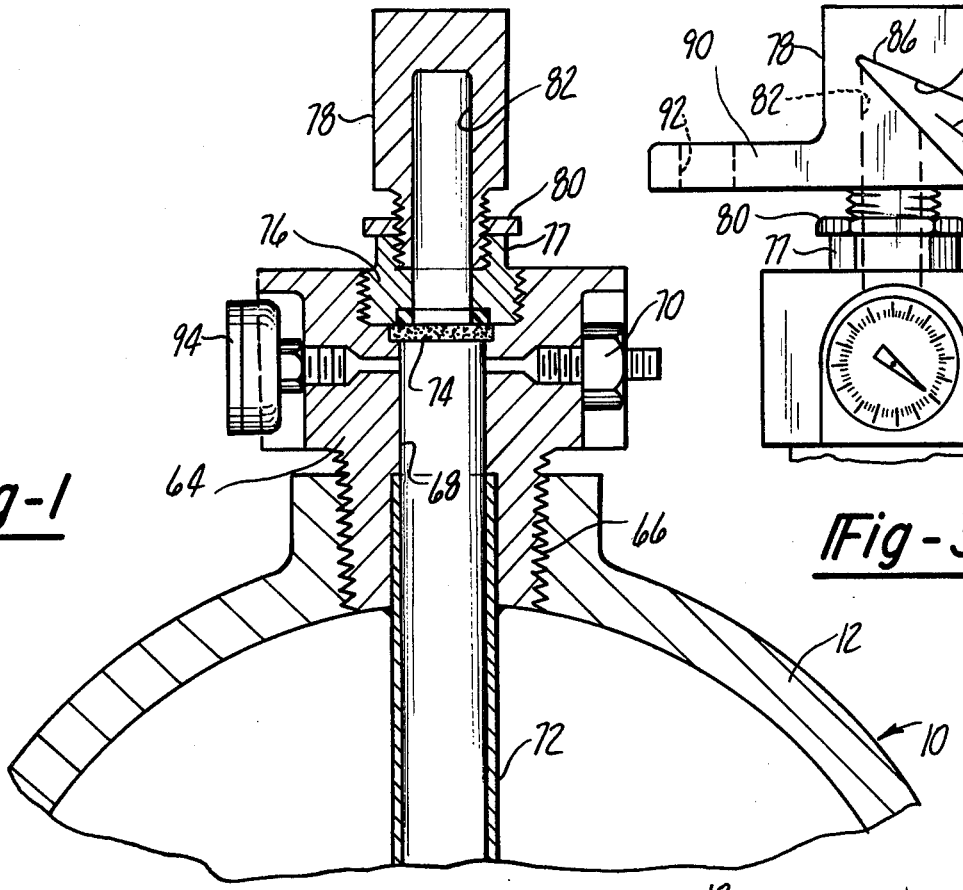
FIG. 1 is a sectional view of the upper section of a fire-extinguishant bottle incorporating this invention.
Figure 2:
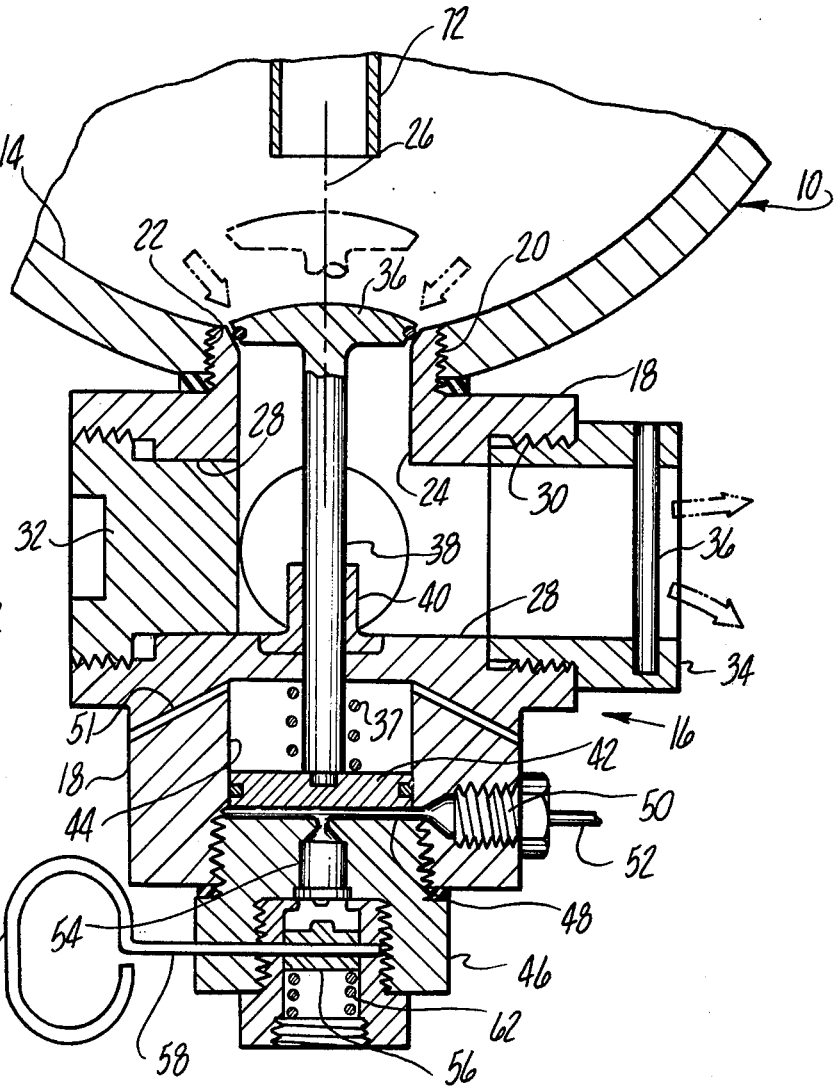
FIG. 2 is a sectional view of the lower section of the FIG. 1 bottle and discharge valve connected thereto.

FIGS. 1 and 2 collectively show a thick-walled steel bottle 10 having a spherical upper end 12 and a spherical lower end 14. The bottle would in one particular case have an internal length (vertical dimension) of about twelve inches and an internal diameter of about five inches, sufficient to contain approximately five pounds of Halon 1301 plus sufficient nitrogen pressurizing agent above the Halon surface for discharging substantially all of the Halon through the discharge valve 16 (at the lower end of the bottle) in less than about 60 milliseconds.

Discharge valve 16 comprises a valve body 18 having a neck extension 20 screwed into a tapped hole in the bottle lower end. The valve body defines a valve seat 22 facing the bottle interior, a circular passage 24 extending downwardly from seat 22 on the bottle axis 26, and four horizontal ports 28 potentially communicating passage 24 with the surrounding atmosphere. Each port 28 includes a threaded counterbore 30 adapted to receive a threaded plug 32 or a threaded sleeve 34. Downflowing liquid extinguishant in central passage 24 is exhausted through each discharge passage defined by the associated sleeve 34. There are four potential discharge directions (assuming each port 28 is equipped with a sleeve 34). However in most situations only one or two of the ports would be utilized for liquid flow; the other ports would be closed by means of an imperforate plug 32. Each sleeve 34 is preferably equipped with a flow-splitter rod 36; the purpose thereof being to diffuse the flow and prevent injury to humans in direct line with the fluid spray.

The number of discharge directions is pre-determined by the location of the bottle in relation to the area being protected. If the bottle is positioned against a wall, e.g., the sidewall of a military personnel carrier, only one or two of the outwardly-facing ports would be required to act as flow passages. If the bottle were positioned in an overhead location spaced from building walls or other obstructions then all four ports might be utilized as flow passages.

Downflow through passages 24 is normally prevented by a valve poppet 36 having an O-ring seal against seat 22. Poppet 36 is connected to a stem 38 that extends downwardly through a guide 40 to an actuator piston 42 slidably positioned within a cylindrical chamber 44. Chamber 44 is a machined cavity in the lower face of valve body 18. A threaded counterbore at the mouth of this cavity receives a threaded plug 46 that seals the space below piston 42.

Figure 3:
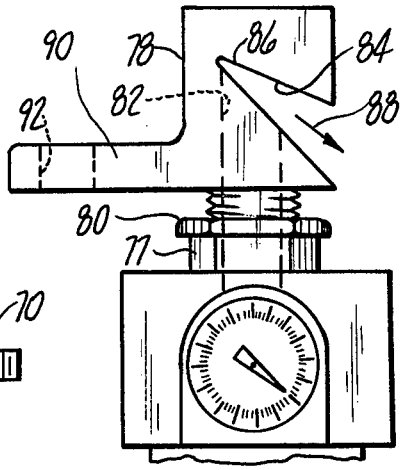
FIG. 3 is a fragmentary elevational view of a multipurpose fitting used in the FIG. 1 bottle for monitoring the bottle pressure, charging the bottle to a desired storage pressure, and safely venting (diffusing) the pressure in event the pressure becomes unsafe.
Figure 5:
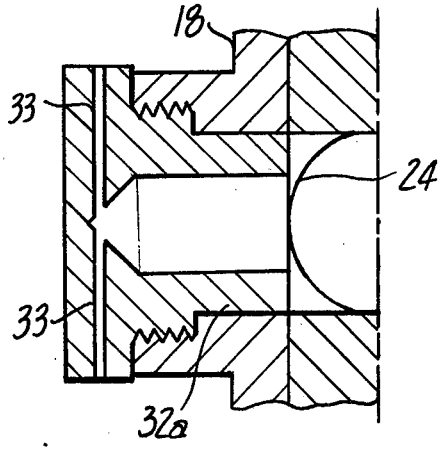
FIG. 5 is a chart depicting the performance of an explosive squib used in the FIG. 2 valve.
Figure 6:
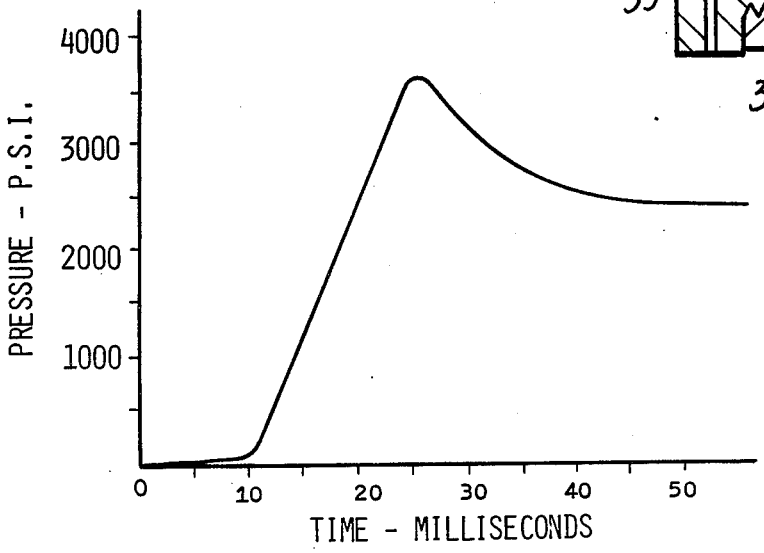
FIG. 6 is a fragmentary view of an anti-recoil plug usable in the FIG. 2 valve.

The upper face of plug 46 may have a slight concavity therein to form a relatively small free space 48 beneath the piston; the spacing of piston 42 from plug 46 may be controlled by the engagement of poppet 36 on seat 22 due to pressure existing within bottle 10. A small hole is drilled laterally through valve body 18 to conduct explosive gases generated by conventional squib 50 into the small concavity 48, thereby pressurizing the piston lower face to a pressure between about 3000 and 4500 p.s.i. Squib 50 is a commercially available device such as the Apco squib, part No. 805300-6; it includes an internal burn-wire igniter for the explosive charge, said igniter being connected to a lead wire 52 coming from a voltage source controlled by a photo-electric sensor or other trigger device (not shown). Attached FIG. 5 shows approximate pressure values obtained in actuation chamber 48 after electrical energization of lead wire 52; the first few milliseconds in FIG. 5 represent ignition lag before pressurization of the piston can begin. FIG. 5 presupposes that space 48 has an initial volume of about three cubic centimeters. The FIG. 5 curve is a general representation of pressures obtained with the test fixture schematically illustrated in FIG. 7. As there shown, the pressure is generated by an explosive squib 50*a* communicating with a cavity 48*a*, whose volume is about three cubic centimeters. A pressure transducer 49 of the piezo-electric type (e.g., Kistler model 612) senses the cavity pressure and generates an appropriate electric pulse in line 51; the pulse is amplified at 53 and applied to a recorder 55. Pressures obtained in the valve actuation chamber 48 (FIG. 2) may be somewhat different than those depicted in FIG. 3 because the volume of chamber 48 will vary as poppet 36 opens; resistance to poppet movement decreases as the poppet cracks open.

In the actual valve (FIG. 2) high pressurization of the piston 42 lower face causes the piston and connected poppet 36 to move upwardly, thereby enabling pressurized extinguishant to flow from the bottle downwardly through passage 24, thence laterally through the discharge passage(s) defined by sleeve(s) 34. Vent passages 51 in body 18 permit rapid upward movement of piston 42 without excessive dampening effect.

The illustrated valve includes a second potential pressure source for pressurizing the underside of piston 42 in the event that squib 50 fails to fire. This second pressure source (normally not used) consists of a small caliber blank cartridge 54 (22 caliber) positioned above a small piston-like firing pin 56. Cartridge 54 may be of the type commonly used in stud drivers for pins or nails in concrete or sheet metal. Firing pin 56 is normally latched in a retracted non-operating position by means of a lanyard latch wire or rod 58 extending through the pin into aligned openings in the support casing. When a manual pull force is exerted on finger ring 60 rod 58 is withdrawn to the left allowing spring 62 to propel pin 56 upwardly against cartridge 54, thus firing the cartridge by percussion action. Wire 58 can extend across the upper face of pin 56 rather than through an opening in the pin, as shown. The powder charge is exploded to produce the necessary gaseous pressure on pistion 42. Pull ring 60 may be replaced by a flexible cable for remote actuation of rod 58 if that is necessary or more convenient. Alternately rod 58 can be operated in some other manner, as by means of a small electric solenoid, miniature fluid cylinder, or heat responsive power element. Under so-called normal operations cartridge would be a stand-by operator; explosive squib 50 would provide the operating force.

FIG. 2 illustrates two mechanisms for developing actuation pressure on the underface of piston 42. Another mechanism would consist of a remote pressure source, such as a small highly-pressurized bottle or a high pressure liquid pumping system connected to chamber 48 via a small quick-acting valve. The explosive squib 50 is believed to be the most suitable from the standpoints of lowest cost and quickest time response.

Referring now to FIG. 1, there is shown mechanism for filling and charging the bottle (at the factory, military depot, etc.). The mechanism includes a fitting 64 having a neck extension 66 adapted to screw into a tapped hole in the upper end of bottle 10. Fitting 64 is drilled out to provide a central chamber 68 that communicates with a small charging valve 70 of known construction; this valve is essentially a check valve connectible to a source of pressure fluid (Halon 1301 or nitrogen) for passing fluid into chamber 68 but preventing backflow from that chamber.

Extending downwardly from fitting 64 is a filler tube 72 having a length of about 10 inches, sufficient so that the tube lower end is well below the surface of the liquid extinguishant when the nitrogen pressurizing agent is admitted through valve 70; the pressurizing agent is caused to bubble upwardly through the liquid so that the saturation limit is substantially achieved during the charging operation.

Figure 4:
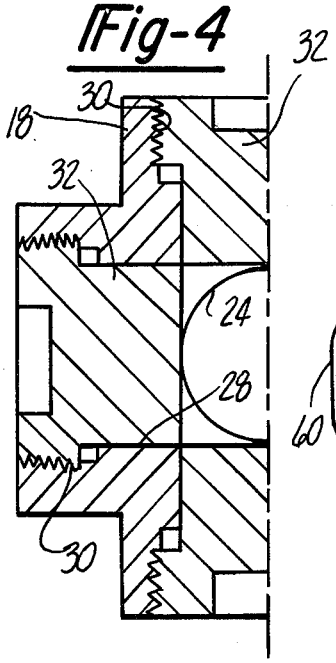
FIG. 4 is a fragmentary sectional view through a flow-interrupter plug used in the FIG. 2 mechanism.

During the charging operation it is necessary that poppet 36 be seated firmly on seat 22. This may be accomplished by a light compression spring 37 acting downwardly on piston 42. Alternately a positive pull-down rod (not shown) may be connected to piston 42 (after removal of plug 46) to ensure a seated condition of poppet 36. During the charging operation any pressure fluid inadvertantly escaping across seat 22 will vent through ports 28; vented diffuser plugs 32a (FIG. 4) can be screwed into counterbores 30 to minimize potential human injury due to flow action. Each plug 32a is formed with six or more radial holes 33 for diffusing the flow in different directions, thereby preventing a concentrated flow that could prove harmful. Plugs 32a would be used during the charge-in period. During service plugs 32a would be replaced by the aforementioned plugs 32 and/or 34.

The charge-in fitting 64 mounts a conventional rupturable safety disc 74, such as a graphite structure known as "GRAFSERT" having a rating of about 1500 p.s.i. Disc hold-down nut 76 has a hexagonal extension 77 for wrench actuation of the nut. Also, this nut is internally threaded to receive the threaded extension of a block element 78; a lock nut 80 secures element 78 on nut 76.

Element 78 functions as an emergency type deflection mechanism for pressurized fluid passing upwardly through tube 72 and chamber 68 after rupture of safety disc 74. Element 78 is drilled, as at 82, to form a duct for directing this upflow against a roof surface 84 (FIG. 3) formed by a wedge-shaped slot 86 extending generally transverse to hole 82. Roof surface 84 causes the fluid to be directed primarily downwardly as designated by numeral 88 in FIG. 3.

The function of element 78 is to cause pressurized fluid escaping past disc 74 to be directed downwardly into the space surrounding bottle 10 rather than upwardly away from the bottle. In most cases disc 74 will rupture due to abnormally high internal bottle pressure, e.g., above 1500 p.s.i. Such high internal pressures would be due to external heating by fires in the immediate vicinity of the bottle. Element 78 is designed to direct the vented extinguishant liquid downwardly near the bottle side wall, thus cooling the bottle and precluding an explosive condition dangerous to human life. Wedge slot 86 extends completely through element 78 to provide satisfactory free area for non-restricted flow, primarily in the direction of arrow 88 but also through the ends of the slot. The aim is to redirect the flow downward without significantly retarding the flow rate.

The bottle may be supported in any conventional fashion. However, for this purpose we show in FIG. 3 a flange extension 90 on block 78, said flange extension 90 having a vertical hole 92 therethrough adapted to fit onto a pin-like wall bracket (not shown). Flange extension 90 serves as a bottle suspension device while the bottle is being charged and also when put into service (e.g., in a military vehicle). A strap or similar device would encircle the mid portion of the bottle to prevent any wobble thereof.

During the bottle-charging operation and also during service periods it is desirable that the user be able to monitor the bottle pressure for assurance that the system is at all times in a readiness state. In the illustrated system the pressure may be continually monitored by a conventional pressure gage 94 (diaphragm of Bourdon tube) mounted on fitting 64.

It will be noted that in this system the operations of filling and pressurizing the bottle, monitoring the pressure, and safely venting excess pressures (disc 74) are performed or accomplished at the upper end of the steel bottle. The structure for discharging the extinguishant toward the fireball is located at the lower end of the bottle. By utilizing both the upper and lower ends of the bottle for the different functions it is believed possible to make each structure readily accessible without complicating the passage system or adding undue bulk to the system. Valve 16 would in many cases have a vertical dimension of approximately three inches; fitting 64, and its associated structure, would have a vertical dimension of 2 or 3 inches.

Valve structure 16 has a relatively short passage length from seat 22 to splitter ring 36, thereby saving some transport time between the bottle and the fireball. Further transport time is saved because the actuating piston 42 is rigidly connected to valve element 36; there is no lost motion as occurs between an annular cutter element and rupturable diaphragm used in the prior art. The illustrated valve should also be relatively fast-acting because piston 42 can be formed with a relatively large face area (high force) for a given passage 24 area; in the illustrated valve the piston has approximately the same area as the valve. The poppet valve 36 requires considerable force to crack open; however after the initial crack-open period the pressures rapidly equalize across the valve so that the valve completes its stroke rather quickly. In the valve shown in the drawing the stroke length necessary to go from the closed position (full lines) to the full open position (dotted lines) is about one half the valve diameter.

Size of passage 24 can be suited to flow requirements because poppet valve 36 is a rigid structure that can be manufactured in various diameters (small or large). Unsupported diaphragm type valves as used in certain ones of the prior art systems are believed to be rather limited in diameter.

We wish it to be understood that we do not desire to be limited to the exact details of construction shown and described for obvious modifications will occur to a person skilled in the art.

We claim:

1. Fire-extinguisher mechanism comprising an upright thick-walled bottle containing pressurized fire-extinguishant; an extinguishant dicharge valve body mounted on the lower end of the bottle; the extreme upper end of said valve body defining a valve seat facing the bottle interior, said valve seat being located in the plane of the bottle bottom wall in direct fluid communication with the bottle interior whereby pressurized suppressant on the bottle bottom wall is enabled to reach the valve seat by radial inflow toward the valve seat axis, a first passage extending from the valve seat downwardly along the bottle axis, and at least one other discharge passage extending from the first passage approximately normal to the bottle axis; a valve poppet seatable on the aforementioned valve seat for normally preventing flow out of the bottle; said valve body including wall structure that forms a valve actuation chamber directly below the first passage; a valve-actuator piston slidably arranged in said chamber for upward advancement along the bottle axis toward the valve seat; and a stem rigidly connecting the piston and valve poppet, whereby upward advancement of the piston within the chamber causes the valve poppet to move upwardly away from the valve seat into the bottle interior thereby enabling pressurized extinguishant to flow downwardly from the bottle through the aforementioned passages; an explosive squib (50) mounted on the valve body in fluid communication with the chamber space below the piston, said squib being capable of generating a sufficiently high gaseous pressure on the lower face of the piston to produce rapid upward advancement of said piston within the actuation chamber; and means for filling and pressurizing the bottle comprising a fitting (64) mounted on the upper end of the bottle to define a central chamber (68) on the bottle axis, a check valve mounted on the fitting for admittng fluid to the central chamber (68), and a filler tube extending from the fitting downwardly into the bottle for transporting fluid from the central chamber (68) to a point in the bottle adjacent the aforementioned poppet valve; said filler tube constituting a mechanism for supplying a pressurizing agent to the lower portion of the bottle whereby said agent is allowed to bubble upwardly through the liquid extinguishant before pressurizing the space above the liquid surface.

2. The mechanism of claim 1 and further comprising auxiliary actuator mechanism for operating the piston in the event that the squib fails to fire; said auxiliary actuator mechanism comprising an explosive powder cartridge communicating with the lower face of the piston, a spring-urged firing pin aligned with the cartridge for firing same by percussion action, and latch means normally holding the firing pin in a retracted condition against the spring actuation force.

3. The mechanism of claim 1 and further comprising a rupturable safety disc mounted in the fitting at the upper end of the central chamber.

4. The mechanism of claim 3 and further comprising a pressure gage mounted on the fittng for monitoring the pressure in the aforementioned central chamber.

5. The mechanism of claim 1 and further comprising a rupturable safety disc mounted in the fitting to extend across the upper end of the central chamber; and means for downwardly deflecting the pressurized fluid that is vented from the bottle through the disc after its rupture.

6. The mechanism of claim 5 wherein the deflecting means comprises a flow-confining duct for directing the pressurized fluid upwardly from the ruptured disc, and a roof spaced above the upper end of the duct for redirecting the fluid in a downward direction toward the space immediately adjacent the bottle.

7. The mechanism of claim 6 wherein the deflecting means comprises a horizontal block element having a vertical hole extending from its lower face to define the aforementioned duct; said block element having a wedge-shaped slot extending transverse to the hole to define the aforementioned roof.

8. The mechanism of claim 7 wherein the block element is provided with a laterally extending flange contoured to function as a suspension means for the bottle.

9. The mechanism of claim 5 wherein said valve body and said fitting are each formed with an externally threaded neck adapted to screw into a tapped hole in an end of the bottle for support purposes.

* * * * *